US005094223A

United States Patent [19]

Gonzalez

[11] Patent Number: 5,094,223

[45] Date of Patent: Mar. 10, 1992

[54] WOOD BURNING PORTABLE FIRE PIT GRILL APPARATUS

[76] Inventor: Lennie Gonzalez, 3523 Grand Blvd., East Chicago, Ind. 46312

[21] Appl. No.: 696,878

[22] Filed: May 8, 1991

[51] Int. Cl.[5] ..... A47J 37/00

[52] U.S. Cl. ..... 126/25 R; 126/25 B; 126/41 R; 126/50

[58] Field of Search ..... 126/25 R, 25 B, 41 R, 126/9 R, 39 R, 50; 431/354, 344, 343

[56] References Cited

U.S. PATENT DOCUMENTS

| | | | |
|---|---|---|---|
| 404,063 | 5/1889 | Wallwork et al. | 431/344 |
| 2,484,239 | 10/1949 | Moon et al. | 126/9 R |
| 2,920,243 | 1/1960 | Taren | 126/25 B |
| 3,410,261 | 11/1968 | Cooper et al. | 126/25 B |
| 3,529,557 | 9/1970 | Treanor | 126/25 B |
| 3,589,312 | 6/1971 | Cooper | 126/25 B |
| 3,605,653 | 9/1971 | Donnell | 126/25 B |
| 3,765,397 | 10/1973 | Henderson | 126/25 R |
| 3,814,035 | 6/1974 | Miller | 126/25 B |
| 3,915,144 | 10/1975 | Tomita | 126/9 R |
| 4,895,131 | 1/1990 | Overholser | 126/41 R |
| 4,903,683 | 2/1990 | Larsen et al. | 126/25 B |
| 4,909,235 | 3/1990 | Boetcker | 126/9 R |

FOREIGN PATENT DOCUMENTS 2075175 11/1981 United Kingdom ..... 126/25 B

OTHER PUBLICATIONS

1990 The Scope catalog, Weber Model 2710, p. 28.

Sporty's Preferred Living catalog, Nov. 7, 1989, p. 6.

*Primary Examiner*—James C. Yeung

*Attorney, Agent, or Firm*—Richard G. Kinney

[57] ABSTRACT

A portable wood burning fire pit apparatus is disclosed which includes a fire bowl base, a cylindrical wood receiving chamber defined by expanded metal walls above the fire bowl, a pair of separately controlled gas rings encircling the chamber adjacent its side wall at its bottom and middle, a propane gas tank releasably connected to the apparatus and gas rings via a flexible hose and manual quick release coupling. Wood pieces are stacked vertically into the chamber and thus inside the gas rings which, in use, project their flames horizontally toward the stacked wood pieces to advance their burning toward the hot coals state at which time the propane gas and hose may be disconnected and moved away. A removable cooking grill is atop the chamber for use in cooking off the hot coals fire which is achieved in less time than otherwise would be required in a conventional wood fire.

20 Claims, 3 Drawing Sheets

WOOD BURNING PORTABLE FIRE PIT GRILL APPARATUS

FIELD OF THE INVENTION

The present invention relates to portable fireplaces or fire pits [U.S. Class 126/25R].

BACKGROUND OF THE INVENTION

Portable fireplaces and fire pits are used by campers and homeowners to provide outdoor heat and the pleasant appearance of a wood fire. Commercial portable fireplaces include the Weber Model No. 2710, depicted on page 28 of the Service Merchandise Catalog, 1989, and one offered at page 6 of Sporty's Preferred Living Catalog (Clermont Airport, Batavia, Ohio 45103-9747). A fire started from wood has eye appeal and presents a pleasant aroma. However, it is not, initially, a very good fire for cooking and it can take a long time to burn wood down to hot coals which are regarded as the best for cooking purposes.

Charcoal has the advantage over wood in that, once started, it can reach the hot coal state earlier than wood and thus is generally preferred for cooking. Charcoal briquettes are, however, difficult to start. Also, charcoal briquettes are more expensive than wood. Indeed, wood can often be found at or around campsites and used at little or no cost.

Portable barbeque grills are often employed for cooking with charcoal briquettes. Starting of charcoal briquettes in such grills by means of portable propane or like starters is shown in U.S. Pat. Nos. 3,589,312; 3,410,261; and 3,605,653. Charcoal briquettes are also started in separate non-gas fired apparatus such as shown in U.S. Pat. Nos. 3,814,035; 3,765,397; and 3,915,144. This latter reference also shows using an electric starter to start a log fire and the aforementioned U.S. Pat. No. 3,589,312 reference suggests using a propane starter in the same manner. Propane gas is also used to stimulate a charcoal briquette cooking fire as shown, for example, in U.S. Pat. No. 4,895,131.

Thus, the camper wishing a hot coals cooking fire must generally choose either to go with relatively expensive and hard to start charcoal briquettes or wait a longer time while the relatively inexpensive wood fire reaches its hot coal state.

SUMMARY OF THE INVENTION

The present invention overcomes the disadvantages of the prior art by providing apparatus for advancing a wood fire to the hot coal status. It provides the appeal and advantages of a wood fire with the time saving of a charcoal fire.

An outdoor wood burning fire pit apparatus constructed in accordance with the present invention includes a walled chamber open to the top in which at least one gas burner is mounted for directing its gas fire to wood, small logs, sticks or like wood pieces, placed generally vertically in the chamber. The gas burner includes an input for receiving gas and mixing it with ambient air. The burner is positioned to direct its flame output laterally or horizontally in said chamber and against the generally vertical wood. Gas burner controls are also provided coupled between the burner and a gas inlet located outside the chamber. Also, a source of gas under pressure separated from the chamber and burner is connected to the inlet by manual detachable connection. This connection allows for the releasable connection of the source of gas to the burner so that the wood logs placed into the chamber may be more quickly started on fire and more quickly burned into a hot coals fire by operating the burner and the gas source, but then disconnected from the burner and kept at a safe remote location from the now-going hot coals fire.

The invention, together with further advantages and features thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
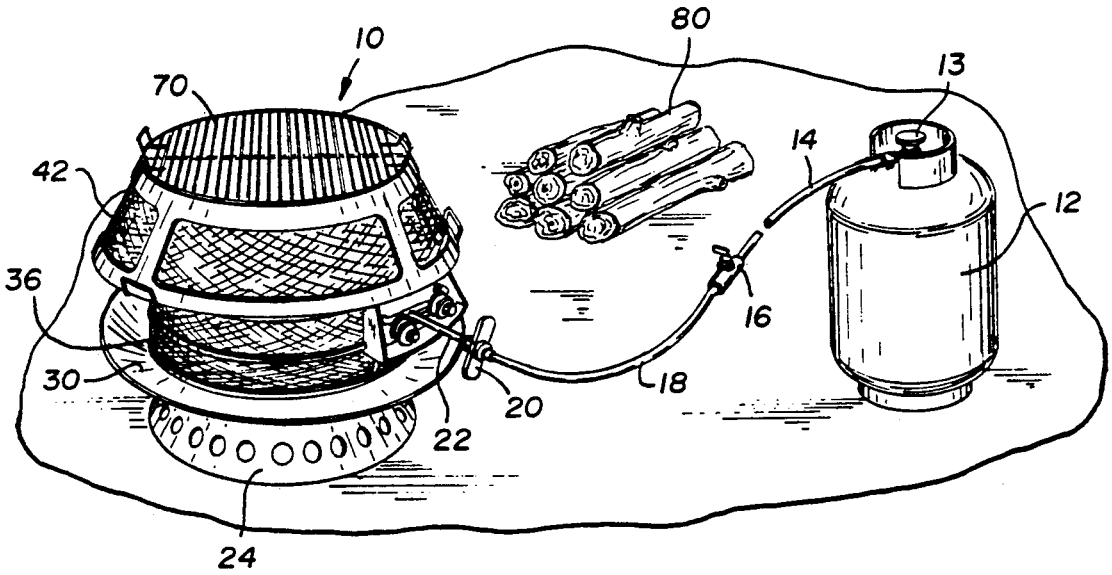
FIG. 1 is a perspective view of an outdoor fire pit apparatus and system constructed in accordance with the present invention shown on a campground with a pile of wood.

Referring to FIG. 1, there is depicted a fire pit apparatus constructed in accordance with the present invention and generally indicated by the number 10. The apparatus 10 is for use outdoors and is, in part, operated from a source of flammable gas such as a twenty-pound propane tank 12 which is also shown in FIG. 1. The tank 12 may be entirely conventional and as such includes a hand operated control valve 13 and suitable conventional pressure regulation mechanism associated therewith. The output from the tank 12 is connected through a flexible hose 14 which may be of any desired length but should be sufficiently long so that the tank 12, for safety, is located remotely from the fire pit apparatus 10 when coupled thereto. A twelve-foot length has worked well in practice. The hose 14 terminates in a hand operated valve 16 which feeds a second hose section 18 which is preferably between 18 inches and two feet in length. The hose section 18 has one end connected to the valve 16 and the other end connected to a quick release manually operable coupling 20. The coupling 20 is also releasably connected to a rigid inlet pipe 22 of the apparatus 10. By a quick hit on the extending arms of coupling 20, the hose and coupling 20 may be easily disconnected from the pipe 22.

Figure 2:
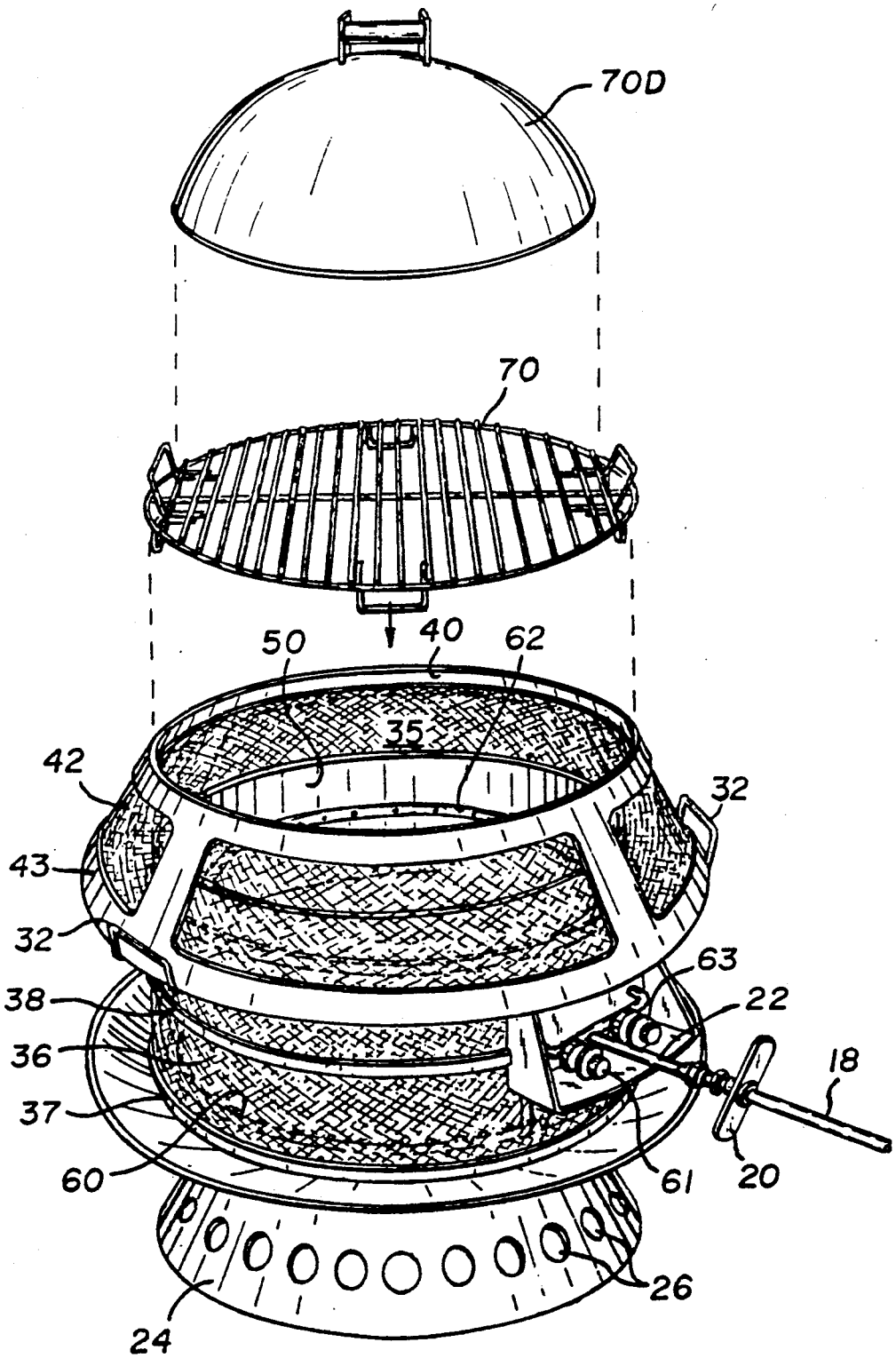
FIG. 2 is a perspective exploded view of the fire pit apparatus of FIG. 1 with an optional lid added.
Figure 3:
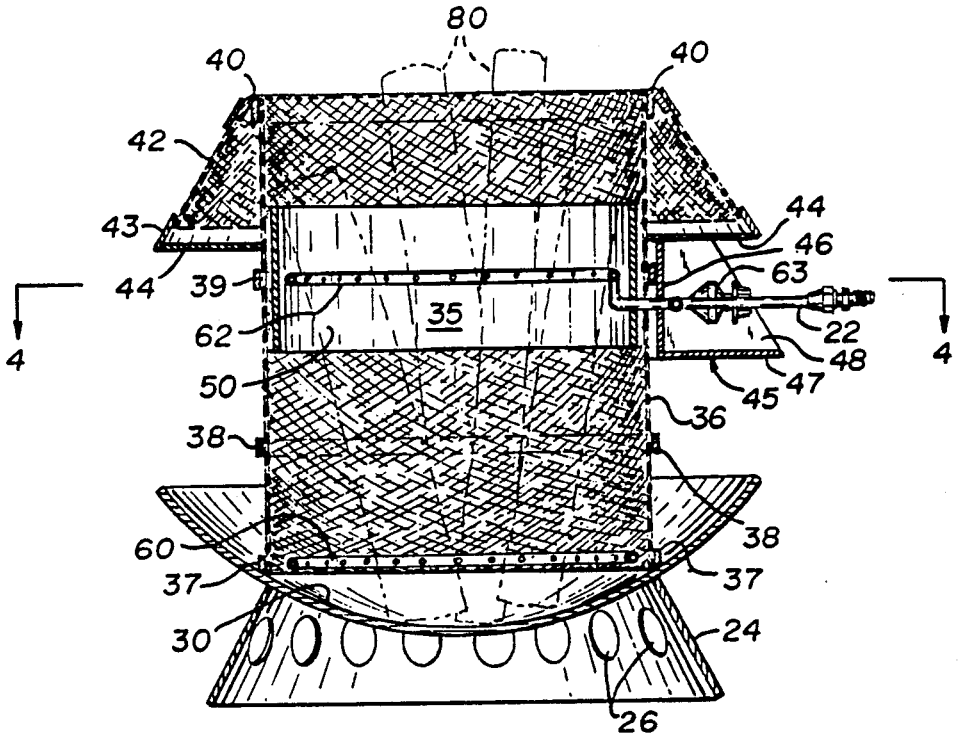
FIG. 3 is a vertical sectional view of the apparatus of FIGS. 1 and 2 showing the loading of wood in it with the wood shown in phantom outline.

The fire pit apparatus 10, especially as shown in FIGS. 2 and 3, includes a base 24, preferably of steel, which supports the apparatus 10 on the ground or other surfaces such as a patio or deck. The base 24 is of a conic section with a wider circular bottom than its circular top and has a plurality of spaced openings 26 which allow air to circulate through and under the base and thus prevent overheating of the surface on which it sits.

The base 24 supports a concave fire bowl 30 preferably also made of steel. The fire bowl 30 is preferably spot welded or otherwise secured to the top edge of the base 24.

Except for the affixing of the base 24 and the bowl 30, the base 24 and bowl 30 resemble a wok, its fire rim, and these were used to construct prototypes. Commercially available 22" woks (of the higher quality construction type) may be employed in the construction of the apparatus 10. Alternatively, outdoor fireplace units such as that shown in the aforementioned Sporty's Preferred Living Catalog may be employed for the bowl 30 and its support 24.

In accordance with the principles of the present invention, the apparatus 10 includes a generally cylindrical shaped fire chamber 35 defined by a tube 36 of expanded metal. The bottom of the tube 36 is reinforced by a steel belt or ring 37, and outer rings 38, 39, 40 encircle the expanded metal tube 36 at about one-quarter and one-half of its height and at its top. The top ring 40 includes an outward and downward flange and serves to help secure a safety skirt 42. The skirt 42 is also preferably made of expanded metal. The use of foraminous or open mesh walls for the majority of the side walls of the chamber 35 and for the skirt 42 allows for good air circulation into the wood fire generated therein and also provides the advantage of making the fire readily visible from the outside of the apparatus 10, especially at night. It also stops and holds in the chamber 35 most of the embers or coals which may be propelled from a burning wood fire. The conic section skirt 42 projects outward and downward from the top rim of the cylindrical chamber 35 and terminates in a generally circular ring 43. The parts 36, 37, 38, 39, 40, 42 and 43 are preferably spot welded together as shown to provide a strong and rigid structure. The skirt 42 serves to keep hands and flammables away from the chamber 35. A pair of handles 32 are welded to the ring 43 for lifting the entire assembly.

As shown in FIG. 3, a shield 50 is provided within the chamber. The shield 50 is made from a thin sheet of metal, preferably steel, and curved so as to surround the chamber 35 and is spot welded to the wall of the tube 36. This shield 50 serves to block a strong wind from blowing flames out the side of the fire pit apparatus 10. The shield 50 is preferably located just inside the wall 36 as shown and is preferably approximately four inches high.

As also best shown in FIG. 3, the skirt 42 includes a generally flat circular shaped wall 44 which extends horizontally from the ring 43 to the outside of the expanded metal tube 36. This wall 44 is preferably welded in place to both the ring 43 and to the wall 36. This wall 44 serves to deflect radiant heat from the bottom of the chamber 35 outward and downward from the fire pit apparatus 10.

Figure 4:
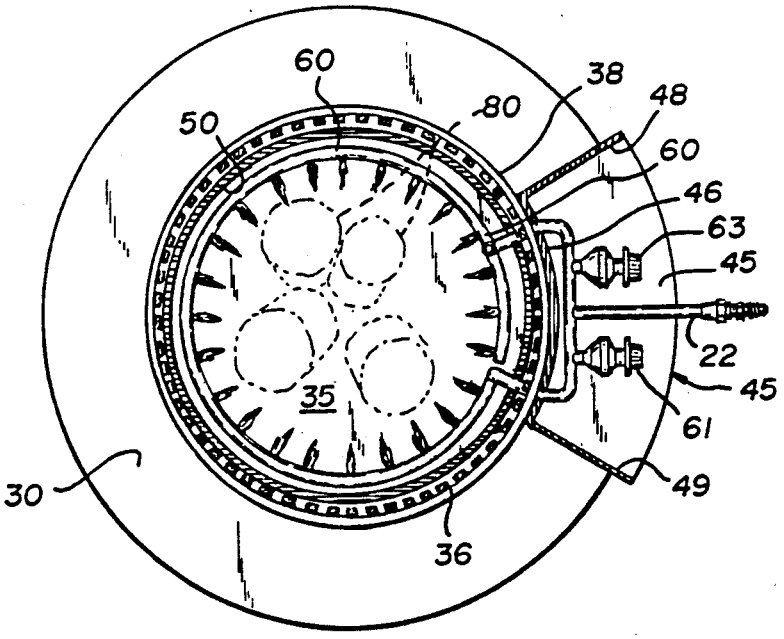
FIG. 4 is a horizontal sectional view of the apparatus of FIGS. 1–3 as seen from the plane of the line 4—4 of FIG. 3 when looking in the direction of the arrows associated with line 4—4 in that figure.

As best seen in FIG. 3, part of the wall 44 also serves as a portion of a shield 45 which surrounds and shields the controls 63 and inlet pipe 22 from the fire in the chamber 35. The shield 45 also includes a curving back wall 46, bottom wall 47, and side walls 48, 49, best shown in FIG. 4. The walls 44, 46, 47, 48, 49, which form the shield 45, are preferably continuously joined together (by e.g. soldering or continuously welding) so as to prevent flames from entering the shielded area from the direction of the chamber 35. To that end, the tubing passing through openings in the rear wall 46 is preferably in a tight fit through these openings.

Inside the chamber 35 are mounted two burner rings 60 and 62 which respectively encircle the chamber 35 at the bottom and at approximately the middle of the chamber. The burner rings 60, 62 each have their flame outputs pointed horizontally inward toward the central vertical axis of the chamber 35. The top burner ring 62 is located at about the middle of the shield 50 which serves to protect its flame output from ambient winds. The bottom burner ring 60 is located within and surrounded by the fire bowl 30. Each burner ring 60, 62 is preferably separately controlled by conventional controls 61, 63 which are fed from branches off of the gas inlet pipe 22.

As shown in FIGS. 1 and 2, a removable grill 70 sized to fit over the top of the chamber 35 may be employed for cooking. In use, the apparatus 10 would be set up essentially as shown in FIG. 1, with a supply of wood logs or like pieces of wood 80 ready to be used in the fire stacked aside. The user would turn on the gas source at valve 13 and turn on valve 16, preferably after checking that the connection 20 is secure. The control 61 would then be turned on and the bottom burner ring 60 lighted by a match or in any other convenient way.

With that ring lighted, the second burner ring 62 is lighted by turning on the control 63 and igniting the gas-air mixture at the ring 62. Once these burners are lit, the wood 80 is inserted (FIGS. 3 and 4) from the top. The grill 70 may be kept off until the wood has reached the hot coal state or else placed on top (FIG. 1). When the wood is burning well on its own and advanced sufficiently toward the "hot coal" condition, the valves 13, 16 and 61 and 63 can be shut off (preferably in that order) and the hose section 18 disconnected by the manually operable quick connection 20. The hoses 18, 14 are then removed from the vicinity of the pit 10.

It should be noted from FIG. 3 that the fire bowl 30 serves to shield the bottom burner ring 60 from horizontal winds and the shield 50 does the same for burner ring 62.

It should now be appreciated that a novel and useful apparatus has been described which allows the use of a propane or like gas fire to "start" wood and turn into a cooking fire more quickly than could be done in the conventional manner.

A prototype of the above-depicted and described apparatus was constructed. This prototype had the walled chamber approximately 16½ inches in diameter and a height of about the same. It is preferred that the fire bowl be about two feet in diameter and the chamber's overall height and diameter be about one and one-half feet. The quick connector 20 is preferably VW Axle Nut Wrench Model No. 2377, available from Easco/K-D Tools, of 7247 National Drive, Hanover, Md., 21075, which is soldered or otherwise permanently affixed in place on a conventional female threaded gas line coupling. That is, the coupling includes a male threaded standard gas coupling at the end of pipe 22 and a standard rotatable female coupling member, with the wrench soldered to it to provide a pair of arms which preferably extend two to three inches from the couplings. By manually striking either arm, the wrench and female coupling member can be made to "spin off" of the male coupling member and quickly disconnect the hose 18 from pipe 22.

The fire pit apparatus is versatile and can be used in a number of different manners and with a number of accessories. One example of an accessory which could be used is a dome-shaped lid which could be employed to cover food on the grill, thus reflect radiant heat onto the food and hold in wood smoke about the food.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. An outdoor wood burning fire pit apparatus for burning wood logs or like wood pieces of the type and size used in home fireplaces and outdoor campfires, comprising:

means defining a walled chamber open to the top in which a number sufficient to provide a working fire of wood logs may be inserted together so as to rest generally vertically in the chamber, said chamber having air inlets into, at least, the bottom area of the chamber;

gas burner means mounted to the chamber for directing its gas fire to wood logs placed in the chamber for igniting and advancing their burning, such gas burner means including an input for receiving gas and mixing it with ambient air and a burner element from which its gas fire is derived, said burner element being positioned to direct its flame output laterally in said chamber and against the logs placed therein;

control means for the gas burner coupled to said burner means, said control means including a gas inlet located on said apparatus outside of said chamber for receiving gas under pressure;

a source of gas under pressure, said source being separated from said chamber and burner means; and manually detachable connection means for releasably connecting and disconnecting said source of gas to said gas burner means, whereby the wood logs placed into the chamber may be more quickly started on fire and more quickly burned into a hot coals fire by operating the burner means and the gas source thereafter disconnected from the burner means and kept at a remote location from the going fire.

2. An outdoor wood burning fire pit apparatus for burning wood logs or like wood pieces of the type and size used in home fireplaces and outdoor campfires, comprising: means defining a walled chamber open to the top in which a number sufficient to provide a working fire of wood logs may be inserted together so as to rest generally vertically in the chamber, said chamber having air inlets into, at least, the bottom area of the chamber;

gas burner means mounted to the chamber for directing its gas fire to wood logs placed in the chamber for igniting and advancing their burning, such gas burner means including an input for receiving gas and mixing it with ambient air and a burner element from which its gas fire is derived, said burner element being positioned to direct its flame output laterally in said chamber and against the logs placed therein;

control means for the gas burner coupled to said burner means, said control means including a gas inlet located on said apparatus outside of said chamber for receiving gas under pressure;

a source of gas under pressure, said source being separated from said chamber and burner means;

manually detachable connection means for releasably connecting and disconnecting said source of gas to said gas burner means, whereby the wood logs placed into the chamber may be more quickly started on fire and more quickly burned into a hot coals fire by operating the burner means and the gas source thereafter disconnected from the burner means and kept at a remote location from the going fire, and wherein said gas burner means burner element encircles the chamber and directs its flame toward the center of said chamber from a plurality of openings radially spaced around the chamber whereby the logs placed therein are surrounded with gas flames.

3. The apparatus of claim 2, wherein said gas burner means includes a second burner element which second burner also encircles the chamber and directs its flame toward the center of said chamber from a plurality of openings radially spaced around the chamber whereby the logs placed therein are surrounded with gas flames.

4. The apparatus of claim 2 wherein said means defining said walled chamber includes open mesh material which defines the majority of the side walls of the chamber.

5. The apparatus of claim 3 wherein one of said burner elements encircles the chamber at about its vertical middle and the other encircles the chamber at about its bottom.

6. The apparatus of claim 5 wherein means are provided for shielding the burners from wind.

7. The apparatus of claim 5 wherein the apparatus includes means defining a fire bowl sized to receive and support the means defining the walled chamber therein and thereabove.

8. The apparatus of claim 7 wherein the fire bowl is larger in lateral extension than the received fire pit chamber defining means and rises vertically above said burner element so as to shield it from horizontal winds.

9. The apparatus of claim 8, wherein said gas burner means includes a second burner element which second burner also encircles the chamber and directs its flame toward the center of said chamber from a plurality of openings radially spaced around the chamber whereby the logs placed therein are surrounded with gas flames.

10. The apparatus of claim 2 wherein said manually detachable connection means includes a rotatable threaded coupling member which has extended arms and which may be manually struck so as to cause the coupling member to spin and quickly decouple the hose.

11. An outdoor wood burning portable fire pit apparatus for burning wood logs or like wood pieces of the type and size used in home fireplaces and outdoor campfires, comprising:

means defining a walled chamber open to the top in which a number sufficient to provide a working fire of wood logs may be inserted together so as to rest generally vertically in the chamber, said chamber having air inlet into, at least, the bottom area of the chamber;

gas burner means mounted to the chamber for directing its gas fire to wood logs placed in the chamber for igniting and advancing their burning, such gas burner means including an input for receiving gas and mixing it with ambient air and a burner element from which its gas fire is derived, said burner element being positioned to direct its flame output laterally in said chamber and against the logs placed therein;

control means for the gas burner coupled to said burner means, said control means including a gas inlet located on said apparatus outside of said chamber for receiving gas under pressure;

manually detachable connection means for releasably connecting and disconnecting a gas hose to said gas burner means, whereby the wood logs placed into the chamber may be more quickly started on fire and more quickly burned into a hot coals fire by operating the burner means and the gas source thereafter disconnected from the burner means and kept at a remote location from the going fire.

12. An outdoor wood burning portable fire pit apparatus for burning wood logs or like wood pieces of the type and size used in home fireplaces and outdoor campfires, comprising:

means defining a walled chamber open to the top in which a number sufficient to provide a working fire of wood logs may be inserted together so as to rest generally vertically in the chamber, said chamber having air inlets into, at least, the bottom area of the chamber;

gas burner means mounted to the chamber for directing its gas fire to wood logs placed in the chamber for igniting and advancing their burning, such gas burner means including an input for receiving gas and mixing it with ambient air and a burner element from which its gas fire is derived, said burner element being positioned to direct its flame output laterally in said chamber and against the logs placed therein;

control means for the gas burner coupled to said burner means, said control means including a gas inlet located on said apparatus outside of said chamber for receiving gas under pressure;

manually detachable connection means for releasably connecting and disconnecting a gas hose to said gas burner means, whereby the wood logs placed into the chamber may be more quickly started on fire and more quickly burned into a hot coals fire by operating the burner means and the gas source thereafter disconnected from the burner means and kept at a remote location from the going fire, and wherein said gas burner means burner element encircles the chamber and directs its flame toward the center of said chamber from a plurality of openings radially spaced around the chamber whereby the logs placed therein are surrounded with gas flames.

13. The apparatus of claim 12, wherein said gas burner means includes a second burner element which second burner also encircles the chamber and directs its flame toward the center of said chamber from a plurality of openings radially spaced around the chamber whereby the logs placed therein are surrounded with gas flames.

14. The apparatus of claim 12 wherein said means defining said walled chamber includes open mesh material which defines the majority of the side walls of the chamber.

15. The apparatus of claim 14 wherein means are provided for shielding the burners from wind.

16. The apparatus of claim 15 plus means defining a fire bowl sized to receive and support the apparatus defining the walled chamber therein and thereabove.

17. The apparatus of claim 16 wherein the fire bowl defining means of said fire base is larger in lateral extension than the received fire pit chamber defining means and rises vertically above said burner element so as to shield it from horizontal winds.

18. The apparatus of claim 17 wherein the fire base is generally round and of the order of two feet in diameter and the apparatus defines a cylinder front burning chamber of a height of the order of two feet and a diameter of the order of one and one-half feet.

19. The apparatus of claim 12 wherein said manually detachable connection means includes a rotatable threaded coupling member which has extended arms and which may be manually struck so as to cause the coupling member to spin and quickly decouple the hose.

20. The method of more rapidly turning wood sticks, small logs and like sized pieces of wood commonly useable in fireplaces or campfires into hot coals using an outdoor wood burning fire pit apparatus for burning wood logs or like wood pieces of the type and size used in home fireplaces and outdoor campfires, comprising:

means defining a walled chamber open to the top in which a number sufficient to provide a working fire of wood logs may be inserted together so as to rest generally vertically in the chamber, said chamber having air inlets into, at least, the bottom area of the chamber;

gas burner means mounted to the chamber for directing its gas fire to wood logs placed in the chamber for igniting and advancing their burning, such gas burner means including an input for receiving gas and mixing it with ambient air and a burner element from which its gas fire is derived, said burner element being positioned to direct its flame output laterally in said chamber and against the logs placed therein;

control means for the gas burner coupled to said burner means, said control means including a gas inlet located on said apparatus outside of said chamber for receiving gas under pressure;

a source of gas under pressure, said source being separated from said chamber and burner means;

manually detachable connection means for releasably connecting and disconnecting said source of gas to said gas burner means, whereby the wood logs placed into the chamber may be more quickly started on fire and more quickly burned into a hot coals fire by operating the burner means and the gas source thereafter disconnected from the burner means and kept at a remote location from the going fire, comprising the steps of (a) connecting up said gas source to said gas inlet and turning on and igniting the gas burner;

(b) thereafter inserting the pieces of wood so that they are generally vertically held in said chamber and exposed to said gas fire for sufficient time to allow the wood pieces to burn and be advanced to the hot coal state; and (c) turning off said gas burner and manually disconnecting said detachable connection means so as to disconnect said source of gas from said gas inlet of said apparatus.

* * * * *